US008596826B2

(12) United States Patent
Aggarwal et al.

(10) Patent No.: US 8,596,826 B2
(45) Date of Patent: Dec. 3, 2013

(54) ACTIVE COOLING SYSTEMS FOR OPTICS

(75) Inventors: Januk Aggarwal, New Albany, OH (US); Yaser S. Abdelsamed, Granville, OH (US); Raymond C. Rice, New Philadelphia, OH (US)

(73) Assignee: ABL IP Holding LLC, Conyers, GA (US)

( * ) Notice: Subject to any disclaimer, the term of this patent is extended or adjusted under 35 U.S.C. 154(b) by 236 days.

(21) Appl. No.: 12/861,449

(22) Filed: Aug. 23, 2010

(65) Prior Publication Data

US 2012/0044678 A1 Feb. 23, 2012

(51) Int. Cl.
*H01J 61/52* (2006.01)

(52) U.S. Cl.
USPC ..... 362/294; 362/373; 362/264; 362/345

(58) Field of Classification Search
USPC ..... 362/294, 264, 345, 373
See application file for complete search history.

(56) References Cited

U.S. PATENT DOCUMENTS 3,596,125 A * 7/1971 Seigel ..... 313/22
5,198,717 A * 3/1993 Kogelschatz et al. ..... 313/17
6,224,248 B1 * 5/2001 Chiba ..... 362/580
6,910,794 B2 * 6/2005 Rice ..... 362/547
7,262,830 B2 * 8/2007 Shigaraki ..... 355/30
7,430,355 B2 * 9/2008 Heikenfeld et al. ..... 385/129
7,461,951 B2 * 12/2008 Chou et al. ..... 362/294
7,524,090 B2 * 4/2009 Hargreaves ..... 362/294
7,753,568 B2 * 7/2010 Hu et al. ..... 362/373
8,096,348 B2 * 1/2012 Takagi et al. ..... 165/170
2008/0043479 A1 * 2/2008 Wang ..... 362/373
2008/0205030 A1 * 8/2008 Hargreaves ..... 362/1
2009/0059594 A1 * 3/2009 Lin ..... 362/294

* cited by examiner

*Primary Examiner* — David J Makiya
*Assistant Examiner* — Bryon T Gyllstrom
(74) *Attorney, Agent, or Firm* — Kilpatrick Townsend & Stockton, LLP

(57) ABSTRACT

Light engines that include a plurality of light sources each covered with an optic The optic includes a chamber that receives the light source. In one embodiment, tubes connect adjacent light sources. Coolant is introduced into the tubes and circulates into the chamber of each optic, thus removing thermal energy from the chamber. In other embodiments, the light engines include a heat sink provided with channels. Coolant may be introduced into one of the channels, and may then circulate into the chamber of each optic to remove heat generated by the light source from the chamber. The channels provide a fluid path for the coolant to move between the different optics.

13 Claims, 11 Drawing Sheets

ACTIVE COOLING SYSTEMS FOR OPTICS

FIELD OF THE INVENTION

The invention relates generally to use of active cooling systems for optics.

BACKGROUND OF THE INVENTION

Light sources emit light for desired applications, but they also emit energy in the form of heat that may be undesirable. For example, a light source may include an electrodeless high-intensity discharge ("HID") lamp that may reach temperatures of 800° C. The temperature may be increased in systems that use an optic in conjunction with the light source. For example, in many systems it is typical to place an optic over the light source so that the optic can direct and concentrate the light. In such systems the optic typically has a chamber that is dimensioned to receive the light source. When the optic is mounted over the light source, the chamber may become very hot due to the heat energy released by the light source. The conditions inside the chamber are the ambient conditions for the light source, and the ambient conditions may greatly affect either the light source or the optic. For example, the light source may become damaged by excessive temperatures or the restrike time (the time it takes for a light source to turn on after it is turned off) may become unacceptably long. Some optics are made of a material with a melting temperature of 140° C., so the optic may melt or burn if the ambient conditions are very hot.

Thus, it may be necessary to reduce or remove the undesirable heat energy from the light source and/or the chamber (if an optic is used). One solution, particularly for electrodeless HID lamps, was simply to position the optic further away from the light source. But these systems were undesirable, because they required large optics that were expensive, heavy, and generally difficult to manage.

Another solution is to use heat sinks to transfer heat from the light sources, but such heat sinks standing alone are typically ineffective at reducing the temperature inside the chamber (the ambient conditions). Additionally, heat sinks may present certain design problems. Specifically, heat sinks are often finned structures that use simple conduction to remove heat. In such systems it is important to minimize the separation distance between the light source and the heat sink, often referred to as the thermal path. As the thermal path increases, the thermal transfer efficiency decreases. But minimizing the thermal path may cause significant practical limitations to the design of the light source and surrounding systems.

An active cooling system may help reduce the limitations caused by conventional heat sinks that use conduction. Specifically, an active cooling system uses a moving coolant (whether liquid or gas) as the carrier between the light source and the heat sink. The thermal transfer efficiency in active cooling systems is governed by the mass flow rate of the coolant and the heat capacity of the coolant. Thus, active cooling systems may be preferred over simple conduction systems because the thermal transfer efficiency is not dependent upon the length of the thermal path. But such known active cooling systems only transfer the coolant outside of the optic. These systems did not transfer the coolant in the chamber created between the optic and the light source. Thus, the temperature inside the chamber (the ambient conditions of the light source) remains high in these known active cooling systems.

Thus, there is a need to provide an active cooling system to adequately reduce the temperature of the ambient conditions of the light source.

SUMMARY OF THE INVENTION

According to certain embodiments, there is provided a light engine that includes a plurality of light sources mounted to a mounting board. An optic covers each light source. The optic includes a chamber that receives the light source. Tubes connect adjacent light sources. Coolant is introduced into one of the tubes and circulates into the chamber of each optic and flows around the light source, thus removing thermal energy from the chamber.

According to other embodiments, there may be provided a light engine that additionally includes a heat sink that is attached to the mounting board. In such embodiments there may be channels running through the mounting board and/or the heat sink. Coolant may be introduced into one of the channels, and may then circulate into the chamber of each optic to remove heat generated by the light source from the chamber. The channels provide a fluid path for the coolant to move between the different optics.

The embodiments described herein are beneficial because they circulate coolant directly inside the chambers of the optics, where heat is transferred to the coolant and thus removed from the chambers.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different features is intended to illustrate like or analogous components.

DETAILED DESCRIPTION OF THE INVENTION

In general, FIGS. 1-6 show various embodiments of light engines having a plurality of light sources and optics, and in general, only the parts of a single light engine and optic are numbered within each embodiment. Unless otherwise noted, it should be understood that the light sources and optics of an embodiment are substantially the same. Thus, although only a single light source and optic may be labeled with reference numbers in an embodiment, the same reference numbering applies for each of the light sources and optics within that embodiment.

Figure 1A:
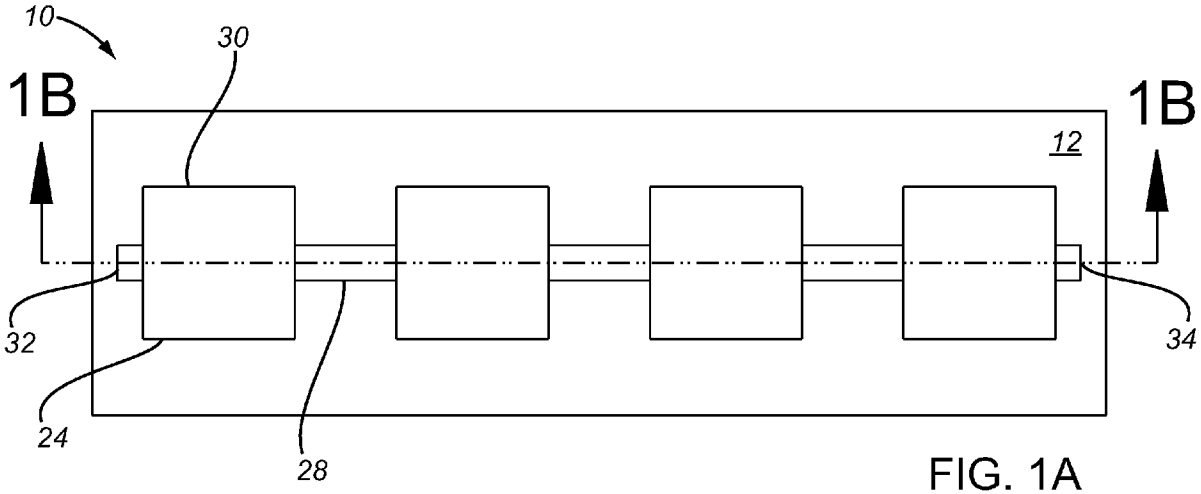
FIG. 1A is a top plan view of a light engine according to certain embodiments of the invention.
Figure 1B:
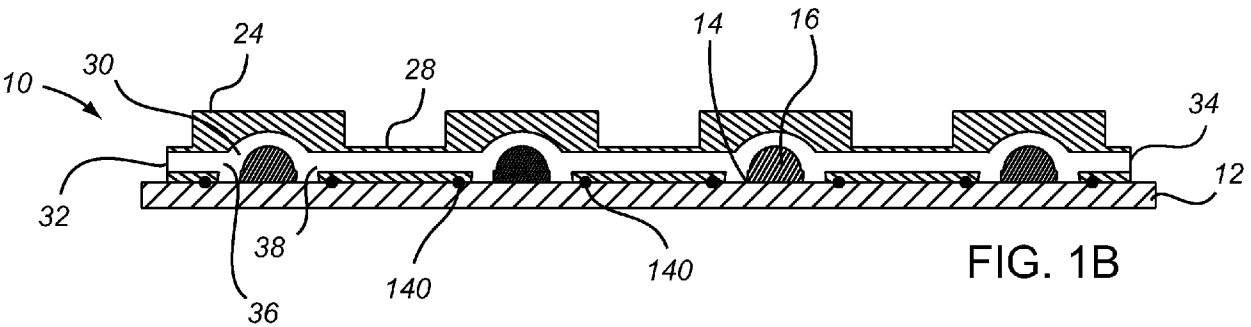
FIG. 1B is a cross-sectional view of the light engine of FIG. 1A taken along line 1B-1B.

FIGS. 1A-B illustrate a light engine 10 according to certain embodiments of the invention. The light engine 10 includes optics 24 and channels or tubes 28 that connect adjacent optics 24. While the optics 24 and tubes 28 may be formed separately and subsequently assembled, some or all of the optics 24 and tubes 28 may be integrally-formed to form a combined optic. Forming a combined optic that is all one piece may improve manufacturing efficiencies, because separate parts need not be formed and then subsequently joined together. A combined optic may be manufactured using a variety of techniques, including but not limited to molding or machining.

Each optic 24 has a chamber 30 that receives a light source 14. As shown in FIG. 1B, the chamber 30 may not conform precisely to the light source 14. Rather, there is a space between the chamber 30 and the light source 14 that allows coolant to circulate around the light source 14 as described herein. The optics 24 shown in FIGS. 1A and 1B are generally square-shaped, but it should be understood that this shape is in no way limiting, and other embodiments may include optics 24 having other shapes. The light source 14 may be mounted to a board 12, including but not limited to a printed circuit board. One such light source 14 might include (but is not limited to) a light-emitting diode ("LED"), an electrodeless high-intensity discharge ("HID") lamp, or a plasma lamp. The light source 14 might include leads or other wiring (not shown in the figures) to connect the light source 14 to other systems outside of the light engine 10, such as power or control systems. In some embodiments the light source 14 includes a primary optic 16, which helps to focus and direct light that is emitted from the light source 14. In the figure, the light source 14 is shown as generally rectangular and the primary optic 16 is shown as a hemisphere; however, it should be understood that these shapes are in no way limiting and other embodiments may include other shapes.

In FIG. 1 there are four light sources 14 (and thus four optics 24) but in other embodiments there may be a different number of light sources 14 with associated optics 24. Additionally, the light sources 14 may be mounted to board 12 in any configuration, including but not limited to the linear configuration as shown in the figures. For example, in another embodiment the configuration may be curved or otherwise bent at an angle.

The tubes 28 connect adjacent optics 24. More specifically, the tubes 28 provide a passageway for coolant to move between the chambers 30 of the optics 24, thus cooling the light sources 14 contained therein. FIG. 1B shows a main coolant inlet 32 on one end of the first tube 28. Coolant then passes through the chamber inlet 36 and is introduced into the chamber 30 of the first optic 24. The coolant may or may not fill up the chamber 30 based on the flow rate of the coolant. The coolant contacts and moves around the light source 14, thus absorbing heat from the chamber 30. Then the coolant exits the chamber 30 through the chamber outlet 38, and enters the next tube 28, where it travels to the next optic 24, where the process is repeated. Coolant may be continuously circulated through the optics 24 as thus described, which lowers the temperature inside the respective chambers 30 to control the ambient conditions of the light sources 14. The embodiment shown in FIG. 1 is thus beneficial because it provides cooling without the need for a heat sink (as shown in FIGS. 2-5); however, it should be understood that a heat sink may be added to the embodiment in FIG. 1 if desired.

Figure 7:
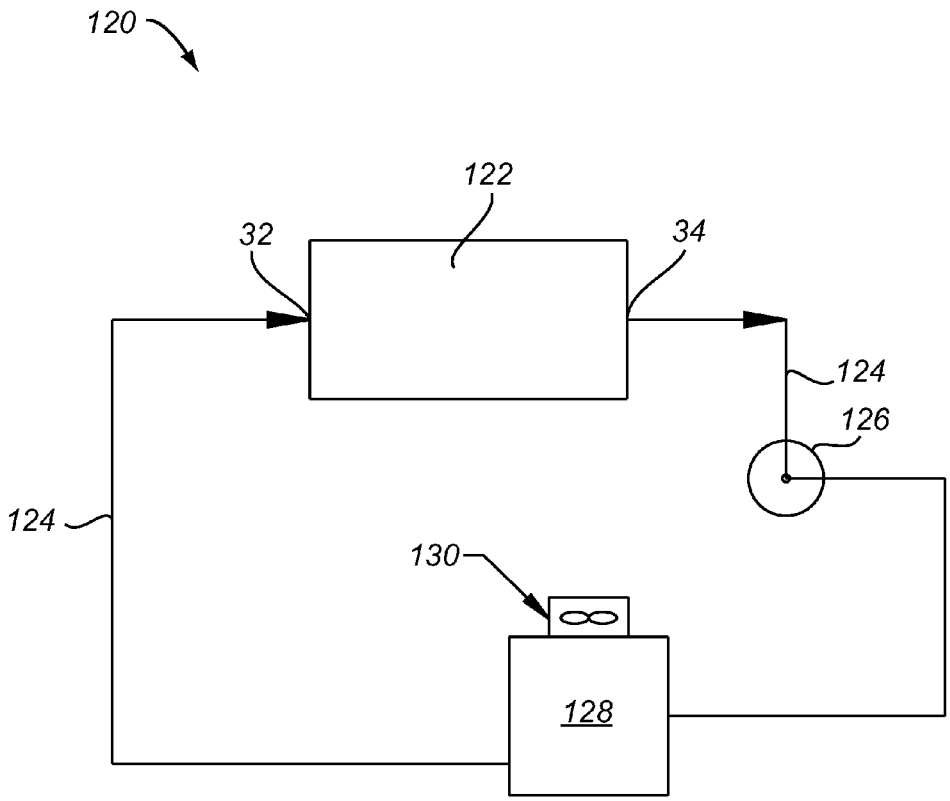
FIG. 7 is a schematic diagram showing an active cooling system according to certain embodiments of the invention.
Figure 8A:
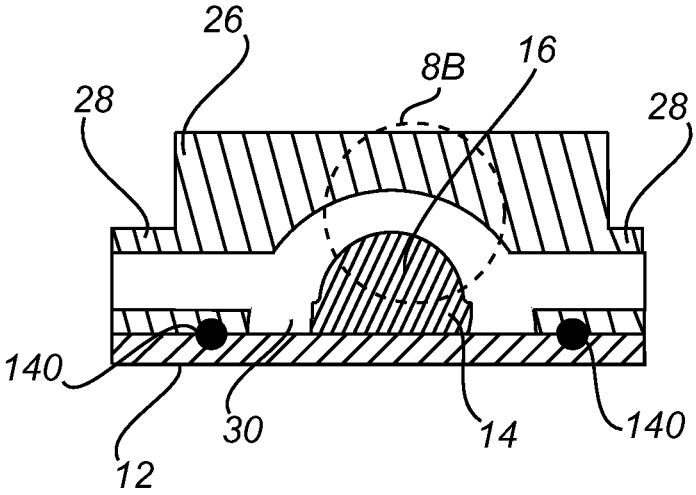
FIG. 8A is a cross-sectional view of an optic that may be used in some embodiments of the invention.

As shown in FIG. 7 and described more fully herein, in some embodiments once the coolant exits the light engine 10 it may be circulated through a coolant path 124. Additionally, in certain embodiments there may also be provided a seal 140 between the optics 24 and the board 12. A detailed view of one embodiment of seal 140 is shown in FIG. 8A. The seal 140 minimizes coolant from leaking between the optics 24 and the board 12.

In one embodiment, both the board 12 and the optics 24 may include recesses (not shown) that are dimensioned to receive the seal 140. Seal 140 may include (but is not limited to) a gasket made of any appropriate material such as rubber or silicone. Thus, when an optic 24 is mounted to the board 12, the seal 140 is pressed into and expands between the recesses in the optic 24 and the board 12, thus providing a seal to prevent coolant from escaping. The seal 140 as shown in FIG. 8A may be included in any of the light engines described in the various figures, but is only an optional feature.

Figure 2A:
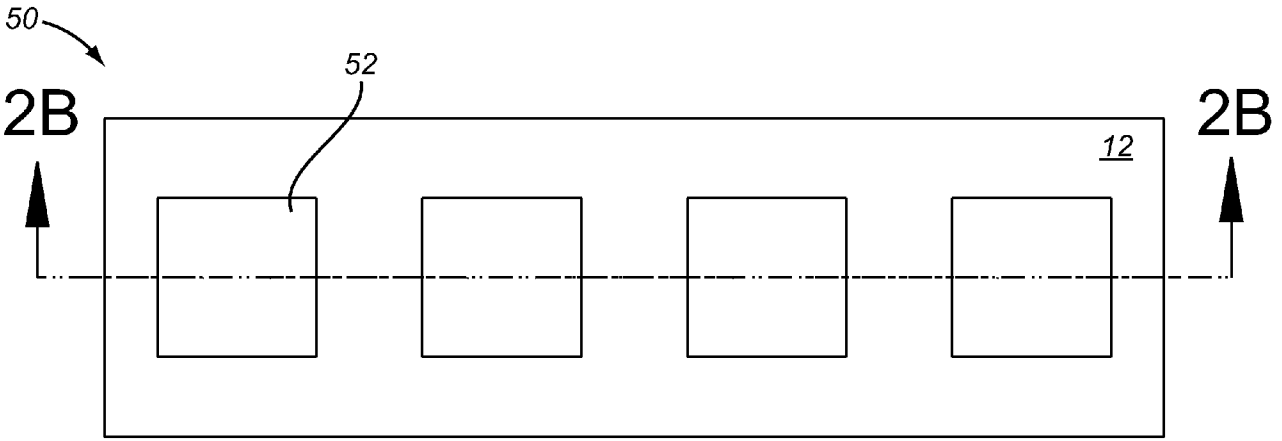
FIG. 2A is a top plan view of a light engine according to other embodiments of the invention.
Figure 2B:
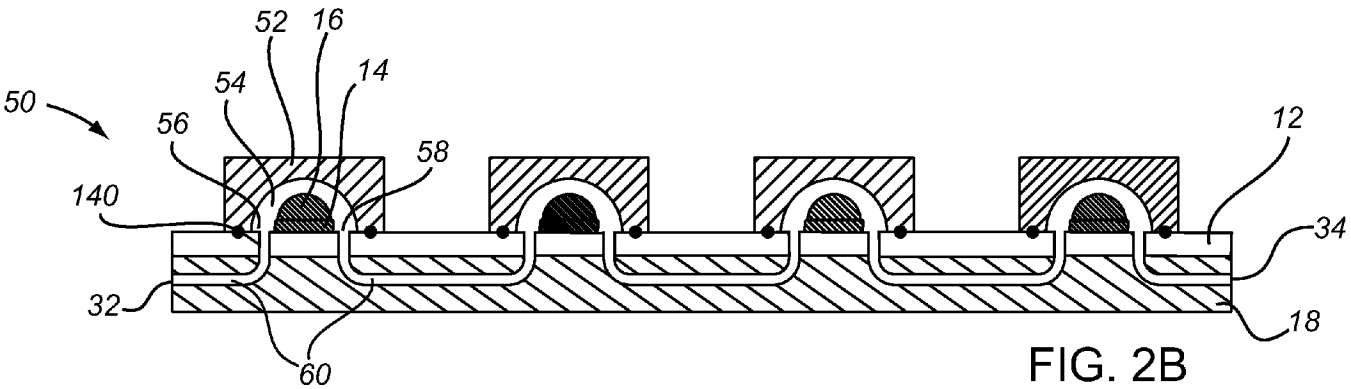
FIG. 2B is a cross-sectional view of the light engine of FIG. 2A taken along line 2B-2B.

The light engine 50 shown in FIGS. 2A-B presents an alternative embodiment that includes optics 52 and channels 60 in the board 12 and/or heat sink 18 that connect the optics 52. An optic 52 may be similar to the optic 24 in FIG. 1 in that it also includes a chamber 54 that is dimensioned to receive a light source 14. The optic 52 shown in FIG. 2 is generally square-shaped, but it should be understood that other embodiments of the optic 52 may have other shapes. Any number of light sources 14 (and thus optics 52) may be mounted to the board 12 in any configuration, as described above with respect to the embodiment of FIG. 1.

The embodiment shown in FIGS. 2A-B includes both a board 12 and a heat sink 18. The heat sink 18 may be composed of any appropriate material, including but not limited to metals such as copper, aluminum, stainless steel, or alloys thereof. Additionally, although not shown in the figures, the heat sink 18 may include additional features that further facilitate thermal transfer, such as fins or channels on a surface of the heat sink 18, or internal channels within the heat sink 18. Such optional features may be selected depending on the intended application of the light engine 50. One of skill in the art might alternatively refer to heat sink 18 as a "manifold plate" or a "cold plate."

The heat sink 18 and the board 12 define channels 60, which provide a passageway between the respective chambers 54 of the optics 52. FIG. 2B shows a main coolant inlet 32 where coolant initially enters the light engine 50. Coolant then passes through the channel 60, into chamber inlet 56, into the chamber 54, and out of the chamber outlet 58 of the first optic 52. Coolant moves between the optics 52 through the channels 60, thus lowering the temperature inside the respective chambers 54 to control the ambient conditions of the light source 14. The channels 60 may be formed in the board 12 and heat sink 18 using a variety of manufacturing techniques, including but not limited to drilling or molding.

If desired, there may also be included a thermal interface material (or "TIM") between the board 12 and the heat sink 18 as shown in FIG. 4 and described more fully below. There may also be provided a seal, such as seal 140 shown in FIG. 8A, between the optic 52 and board 12 such that coolant does not escape through any gaps as it passes through the channels 60. Finally, the light engine 50 in FIG. 2 may be used in connection with a coolant path 124 as shown in FIG. 7.

Figure 3A:
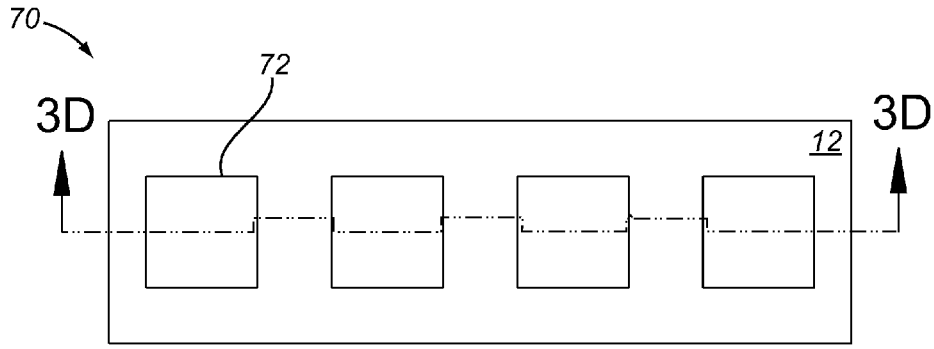
FIG. 3A is a top plan view of a light engine according to other embodiments of the invention.
Figure 3B:
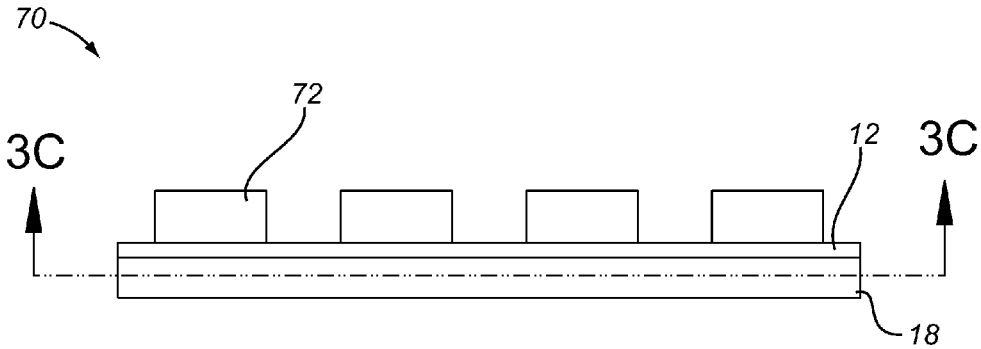
FIG. 3B is a side elevation view of the light engine of FIG. 3A.
Figure 3C:
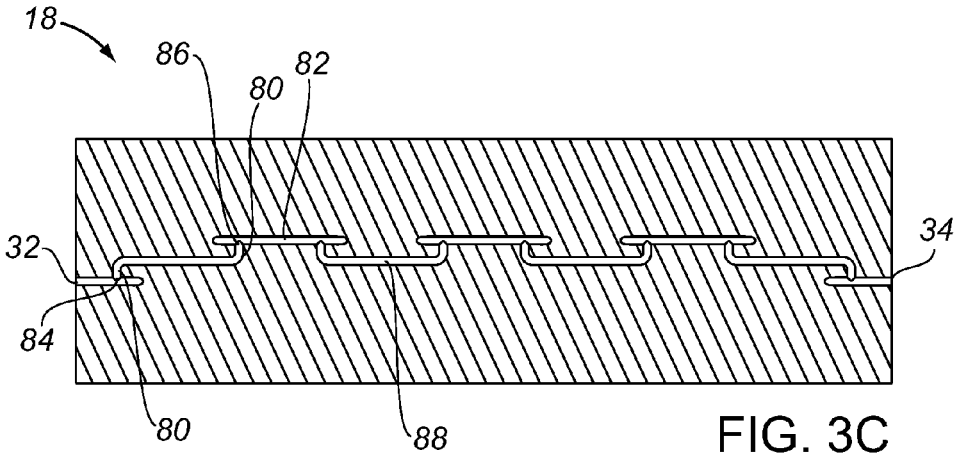
FIG. 3C is a cross-sectional view of the light engine of FIG. 3B taken along line 3C-3C.
Figure 3D:
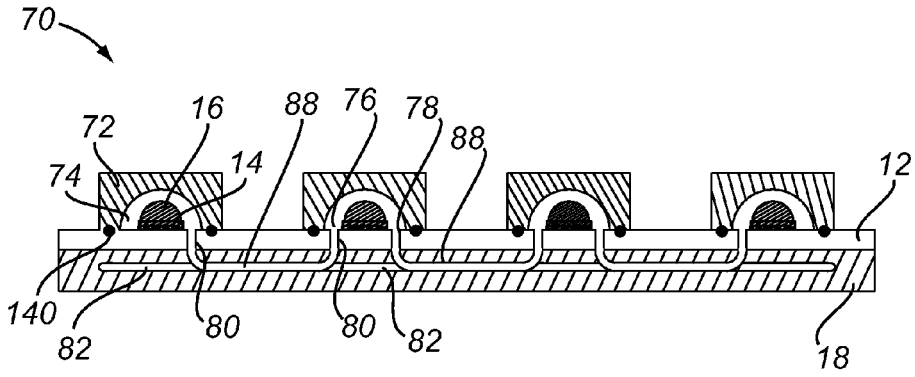
FIG. 3D is a cross-sectional view of the light engine of FIG. 3A taken along line 3D-3D.

FIGS. 3A-D illustrate yet another light engine 70 that includes optics 72 and channels (80, 82, 88, described below) that extend through board 12 and heat sink 18. The optics 72 are similar to the optics 52 shown in FIGS. 2A-B. Light engine 70 includes a chamber channel 80 that transports coolant through the chamber 74 of an optic 72, and a plate channel 82 that transports coolant through the heat sink 18 underneath the light source 14. Coolant enters light engine 70 at the main coolant inlet 32. The coolant is then diverted at the inlet intersection 84. Some of the coolant enters the plate channel 82 that passes through the heat sink 18 underneath the light source 14. But some of the coolant enters the chamber channel 80 and is directed into the chamber inlet 76, then into the chamber 74, exits through the chamber outlet 78, and is directed back down towards the outlet intersection 86. Thus, the chamber channel 80 is shown in FIG. 3D as generally vertical and connected to the chamber 74, whereas the plate channel 82 is shown as generally horizontal and contained within the heat sink 18. Once the coolant exits out of the chamber outlet 78, it mixes with the coolant from the plate channel 82 in the outlet intersection 86. Then the coolant passes through the common channel 88 and to the inlet intersection 84 of the next optic 72, where the coolant flow is diverted as described above. Coolant may be continuously circulated through the light engine 70 as thus described.

The embodiments in FIGS. 2A-B and 3A-D are similar in that both have channels going through the board 12 and/or heat sink 18; however, the light engine 70 in FIGS. 3A-D may be preferred if it is desired to circulate higher volumes of coolant. In FIGS. 2A-B there is only one flow path through channels 60, and thus all of the coolant is introduced into chambers 54 and may contact the respective light sources 14. Such contact between the coolant and the light source 14 might damage the light source 14, especially if it is desired to circulate high volumes of coolant. But the light engine 70 in FIGS. 3A-D includes two flow paths (the channels 80 and 82). Thus, not all of the coolant is introduced into the chamber channel 80 and chamber 74, and thus not all of the coolant contacts the light source 14. Such an embodiment with two flow paths might be beneficial if it is desired to circulate high volumes of coolant. Additionally, the light engine 70 in FIGS. 3A-D may cause a Venturi effect, wherein the velocity and pressure of the coolant varies as between the chamber channel 80 and the plate channel 82. The differences in pressure and/or velocity may create a natural vacuum that helps propel the coolant through the light engine 70 more readily.

If desired, there may also be included a TIM between the board 12 and the heat sink 18 (such as shown in FIG. 4) or a seal 140 between the optic 72 and board 12 (such as shown in FIG. 8A). Additionally, the light engine 70 in FIG. 3 may be used in connection with a coolant path 124 as shown in FIG. 7.

Figure 4A:
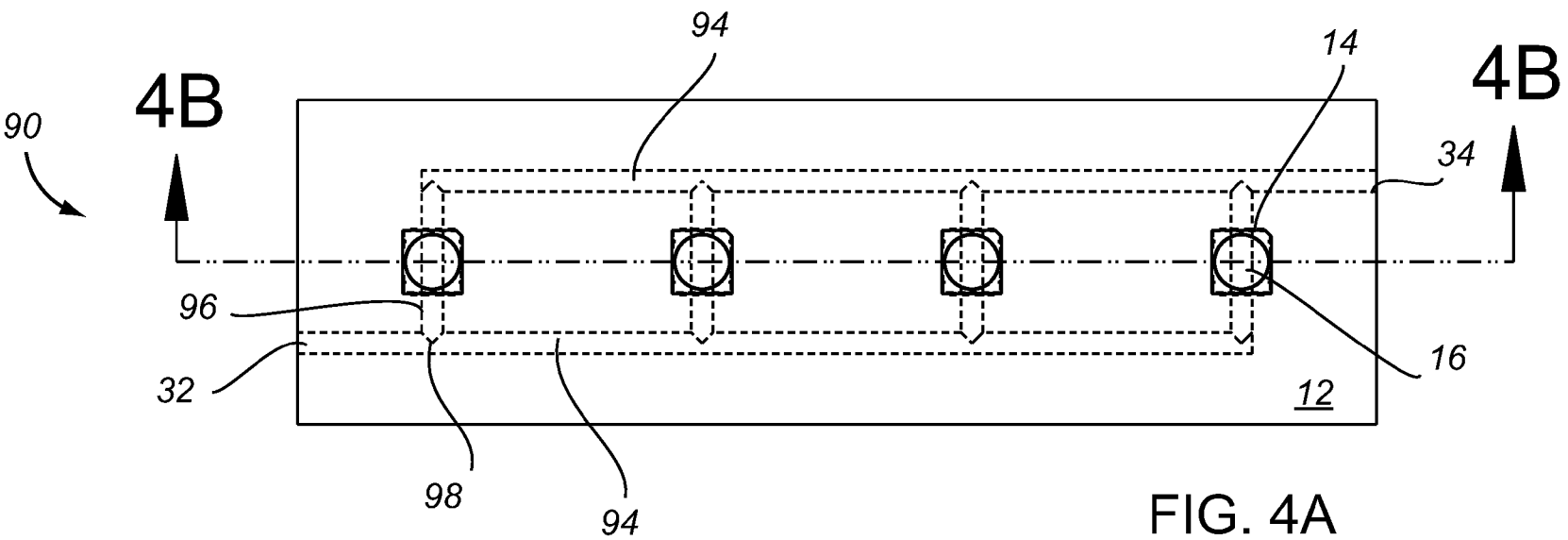
FIG. 4A is a top plan view of a light engine according to still other embodiments of the invention with certain hidden features shown in broken lines.
Figure 4B:
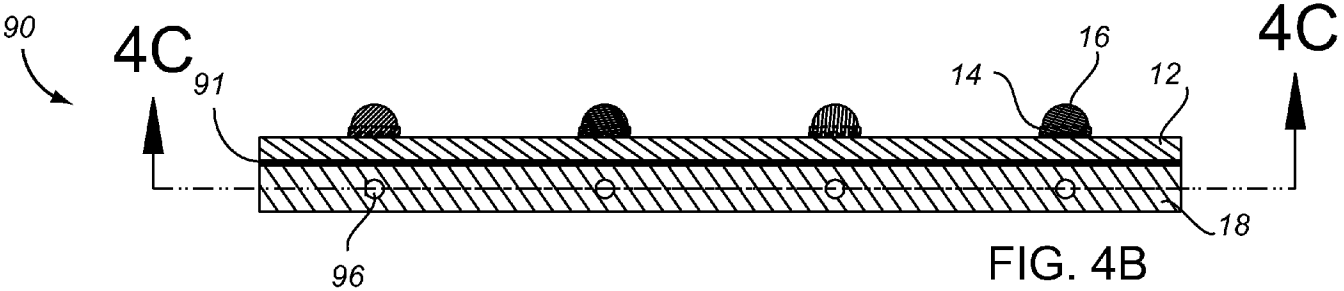
FIG. 4B is a cross-sectional view of the light engine shown in FIG. 4A taken along line 4B-4B.
Figure 4C:
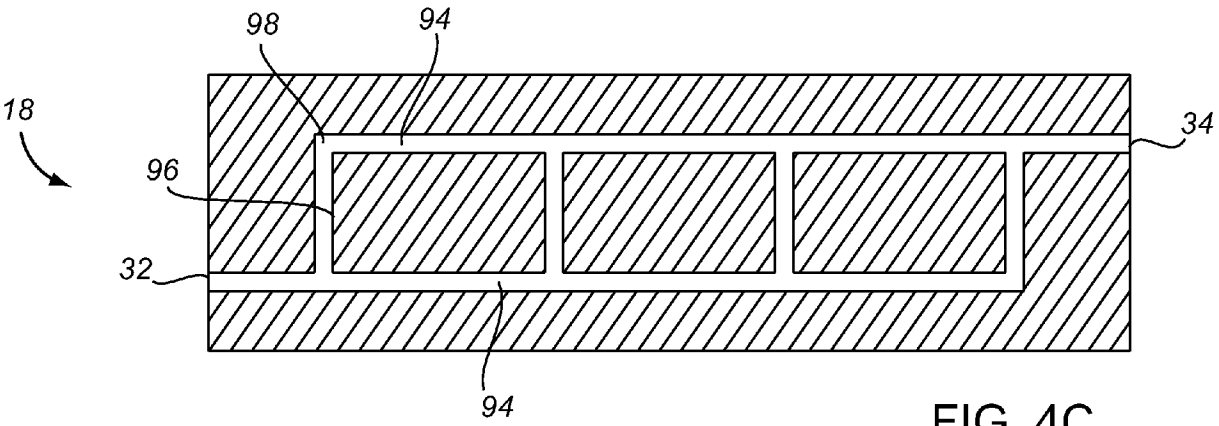
FIG. 4C is a cross-sectional view of the light engine shown in FIG. 4B taken along line 4C-4C.

FIGS. 4A-C illustrate yet another embodiment of a light engine 90 that includes a TIM layer 91 sandwiched between the board 12 and the heat sink 18. FIG. 4A only shows the channels 94, 96 in broken lines—any remaining hidden structures are not shown for simplicity. The embodiment shown in FIGS. 4A-C is not shown with an optic, but one could be added if desired. There may be any number of light sources 14 mounted to the board 12 in any configuration. Heat from the light sources 14 is transmitted through the board 12 and encounters the TIM layer 91. A TIM is used to fill any gap that may exist and thus ensure intimate contact between the board 12 and heat sink 18 to increase thermal transfer efficiency. A TIM may include thermal grease or silicone oil that may be filled with additional materials to increase thermal transfer efficiency, such as aluminum oxide, zinc oxide, boron nitride, or micronized silver. Heat is transferred through the TIM layer 91 and into the heat sink 18.

The heat sink 18 may include internal channels 94, 96 that distribute coolant within the heat sink 18. Specifically, coolant enters the heat sink 18 through main coolant inlet 32, and is diverted at the intersection 98. Some of the coolant enters a Y-axis channel 96 and some enters the X-axis channel 94. The Y-axis channel 96 goes through the heat sink 18 underneath the light source 14, whereas the X-axis channel 94 goes through the heat sink 18, but does not pass underneath the light source 14. Thus, the coolant that passes through the Y-axis channel 96 may be exposed to higher temperatures from the light source 14 than is the coolant in the X-axis channel 94. The coolant continues to flow through the various channels 94, 96 until it ultimately exits at the main coolant outlet 34. In some embodiments, the light engine 90 in FIGS. 4A-C may be used in connection with a coolant path 124 as shown in FIG. 7. Any orientation and configuration of the channels within the heat sink 18 are contemplated and are certainly not limited to the illustrated embodiments.

Figure 5A:
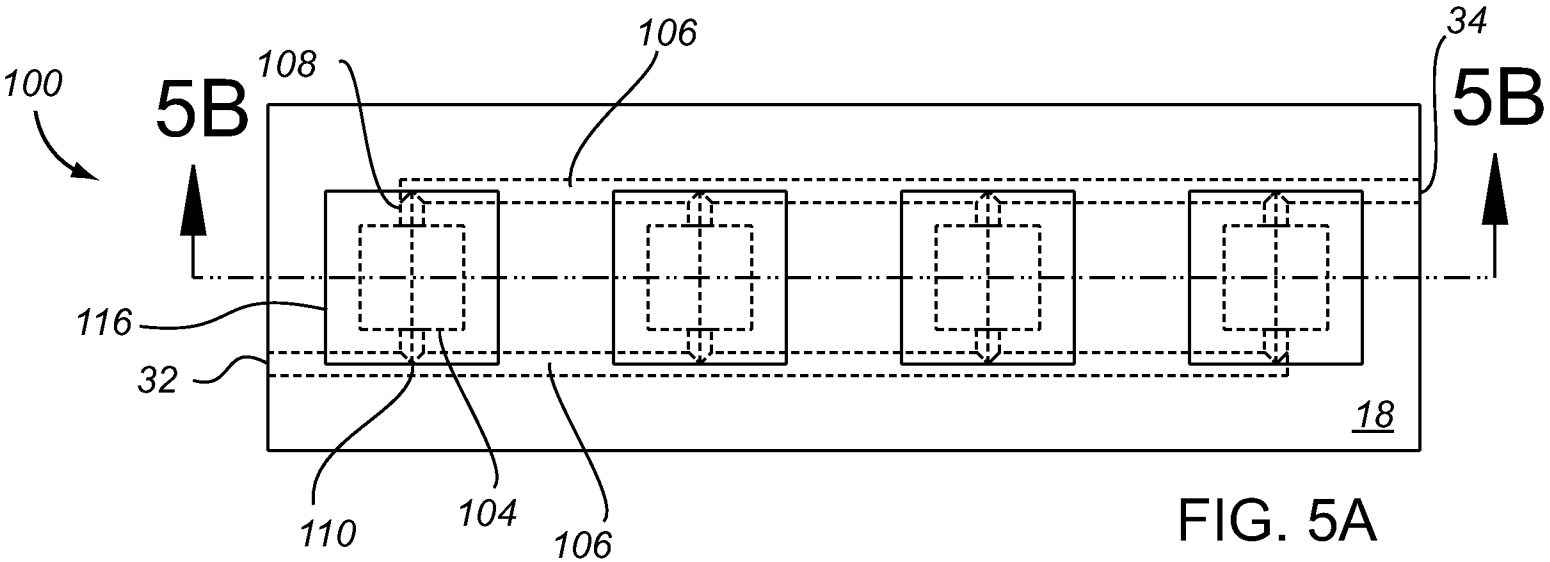
FIG. 5A is a top plan view of a light engine according to still other embodiments of the invention with certain hidden features shown in broken lines.
Figure 5B:
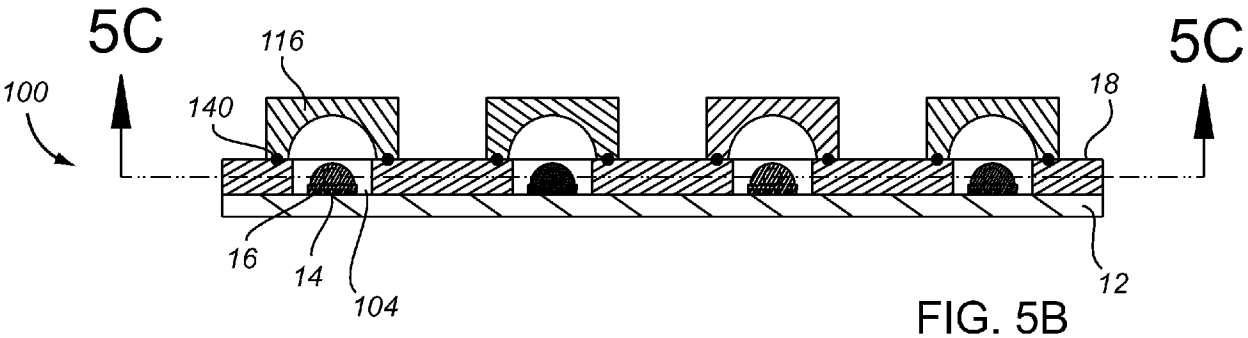
FIG. 5B is a cross-sectional view of the light engine shown in FIG. 5A taken along line 5B-5B.
Figure 5C:
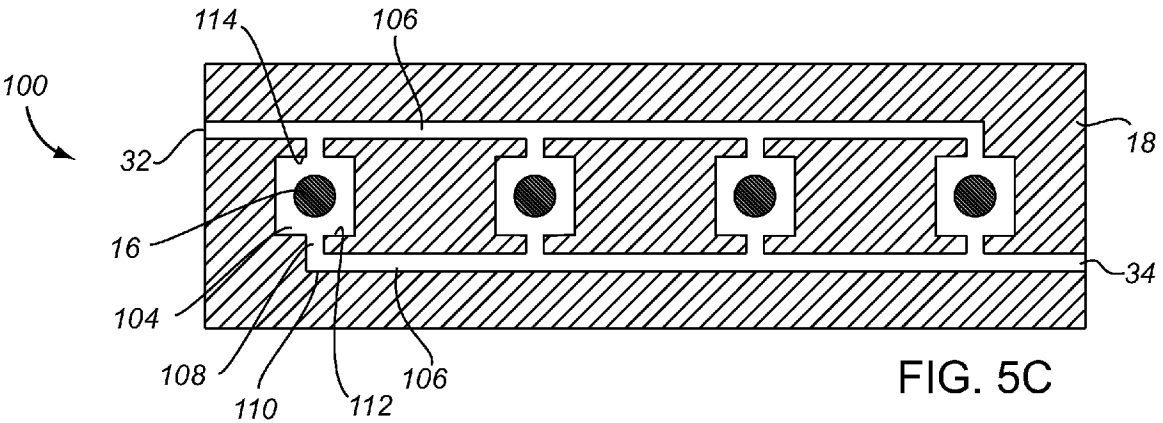
FIG. 5C is a cross-sectional view of the light engine shown in FIG. 5B taken along line 5C-5C.

FIGS. 5A-C illustrate yet another embodiment of a light engine 100 that may include a heat sink 18 with at least one aperture 104 and a series of channels 106, 108. FIG. 5A only shows the channels 106, 108 and aperture 104 in broken lines—any remaining hidden structures are not shown for simplicity. In this embodiment, the heat sink 18 is mounted on the same side of the board 12 as the light sources 14. The heat sink 18 includes apertures 104 that are dimensioned to fit over the light sources 14. In some embodiments, optics 116 are placed on top of the heat sink 18 over the respective apertures 104. The optic 116 encloses the aperture 104 so that coolant does not escape through the aperture 104. There may be a seal 140 between the optic 116 and the heat sink 18 (such as shown in FIG. 8A). There may be any number of light sources 14 mounted to the board 12 in any configuration, and the number of light sources 14 and their configuration is by no means limited to the disclosed embodiments.

As described above with respect to FIGS. 4A-C, the heat sink 18 in FIGS. 5A-C includes an X-axis channel 106 and a Y-axis channel 108 that distribute coolant within the heat sink 18. Specifically, coolant enters the heat sink 18 through main coolant inlet 32, and is diverted at the intersection 110. Some of the coolant enters the X-axis channel 106 and some enters the Y-axis channel 108. The Y-axis channel 108 is connected to the aperture 104. Thus, the coolant enters the aperture 104 through the aperture inlet 112, where the coolant is circulated around the light source 14. The optic 116 covers the aperture 104 and prevents the coolant from escaping the light engine 100. Then the coolant exits through the aperture outlet 114, and continues to flow through the various channels 106, 108 and apertures 104 until it ultimately exits at the main coolant outlet 34.

If desired, there may also be included a TIM and/or a seal 140 between the board 12 and the heat sink 18 and/or between the optic 116 and the heat sink 18 (such as shown in FIGS. 4B and 8A, respectively). Additionally, the light engine 100 in FIGS. 5A-C may be used in connection with a coolant path 124 as shown in FIG. 7.

Figure 6A:
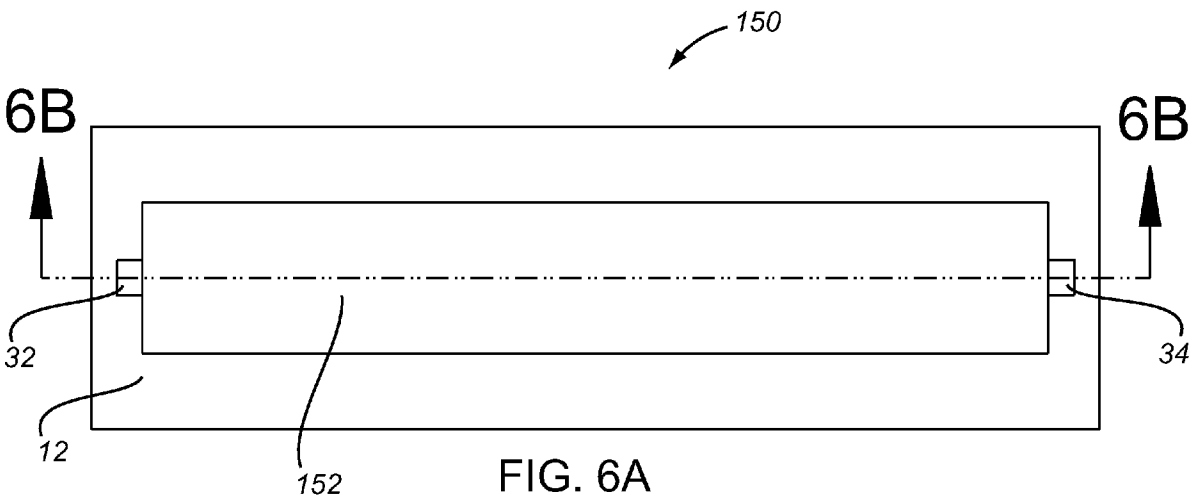
FIG. 6A is a top plan view of a light engine according to still other embodiments of the invention.
Figure 6B:
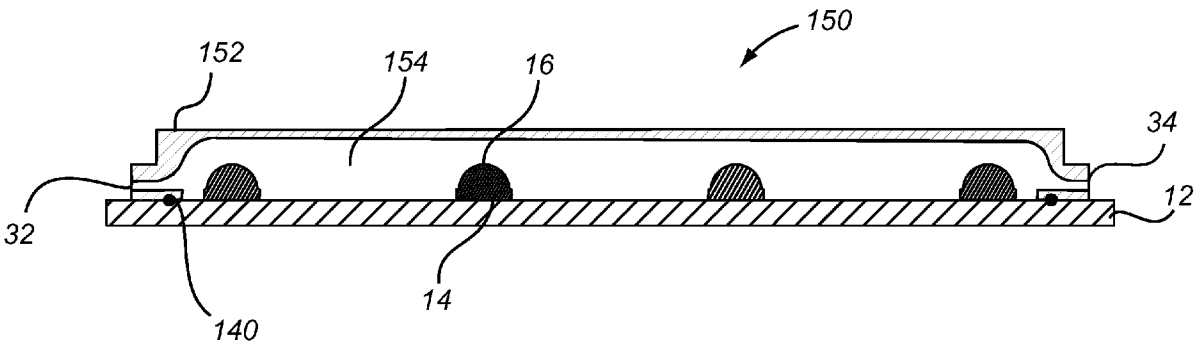
FIG. 6B is a cross-sectional view of the light engine shown in FIG. 6A taken along line 6B-6B.

FIGS. 6A-B illustrates yet another embodiment of a light engine 150 that may include an optic 152 having a single chamber 154 that houses a plurality of light sources 14. Although there are four light sources 14 shown in FIG. 6B, this number is in no way limiting, and other embodiments may have fewer or more light sources 14. Coolant enters the light engine 150 through the main coolant inlet 32, is circulated within the chamber 154 to thereby remove heat from the plurality of light sources 14, and exits at the main coolant outlet 34.

If desired, there may also be included a TIM and/or a seal 140 between the optic 152 and the board 12 (such as shown in FIGS. 4B and 8A, respectively). Additionally, the light engine 150 in FIGS. 6A-C may be used in connection with a coolant path 124 as shown in FIG. 7.

The embodiments of light engines described herein may include either a gas or liquid coolant. Examples of gas coolants include, but are not limited to air, nitrogen, argon, carbon dioxide, or the like. Examples of liquid coolants include, but are not limited to fluorinated hydrocarbon fluid or a silicone fluid. One specific liquid coolant may include fluid called FLUORINERT, which is manufactured by The 3M Company based in St. Paul, Minn. If desired, the coolant (whether gas or liquid) may have a relatively low viscosity, may be electrically insulating, or may be optically clear.

Figure 8B:
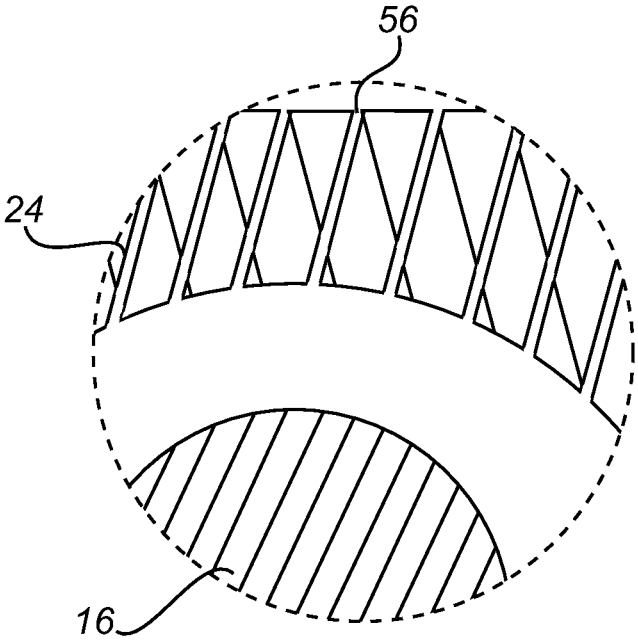
FIG. 8B is an enlarged cross-sectional view of the optic shown in FIG. 8A taken at inset circle 8B.

The various optics (as well as tubes 28) described herein may be composed of any appropriate material, including but not limited to polycarbonate or acrylic. The material may be optical grade if desired. Additionally, in any of the embodiments the optic may allow for transpiration cooling of the light engine. As shown in FIG. 8B, the optic 24 may contain very small channels (micro-channels) 56 that pass through the surface of the optic 24. Heat is transferred outside of the optic 24 by the coolant that passes through the micro-channels 56. Because some coolant may escape through the micro-channels 56, it may be desirable (but is not required) to use a gas coolant. The micro-channels 56 may be created naturally by the porosity of the material that is used to make the optic 24, or they may be created when manufacturing the optic 24. Thus, the material and design of the optic 24 may further increase the thermal transfer efficiency.

In addition, the coolant may increase the thermal transfer efficiency in one of several ways. First, if desired a coolant may be selected that "optically matches" to the material comprising the optic. For example, many plastics that may be used to create the optic may have an index of refraction of around 1.5, and air may have an index of refraction around 1.0. Other liquid fluids, particularly fluorinated hydrocarbon fluids or a silicone fluids, might have an index of refraction closer to that of plastic. Matching the index of refraction of the coolant with that of the optic may minimize the Fresnel reflections as the light enters the optic. Second, the coolant may help reduce the impact of improperly mounted components within the thermal path. For example, the thermal resistance between two surfaces (such as an optic and board as described above) increases if there are any gaps or opens spaces between the two surfaces. A coolant having a low viscosity will tend to fill any such gaps, thus reducing the thermal resistance. Third, the coolant may help create an efficient thermal path between the light source 14 and the optic.

FIG. 7 shows one embodiment of an active cooling system 120 that may be used with either a gas or liquid coolant. The light engine 122 in FIG. 7 generically refers to any of the light engines 10, 50, 70, 90, 100, or 150 described herein. The coolant that exits the light engine 122 at the main coolant outlet 34 is circulated along coolant path 124 by the circulating member 126. The circulating member 126 may include either a pump or a fan. Whatever specific part is used, the circulating member 126 circulates coolant throughout the cooling system 120. Next, the coolant enters the refrigeration system 128 where heat is removed from the coolant. The refrigeration system 128 may comprise a heat sink having a finned structure. In other embodiments, particularly those using a gas coolant, the refrigeration system 128 may comprise a radiator. There may optionally be a cooling fan 130 associated with the refrigeration system 128 that blows air from the surrounding environment over the refrigeration system 128. It should be understood that use of the cooling fan 130 is optional and not required. Finally, the coolant continues on the coolant path 124 back to the main coolant inlet 32 and into the light engine 122 where the cycle is repeated.

The foregoing is provided for purposes of illustration and disclosure of embodiments of the invention. It will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

The invention claimed is:

1. An active cooling system comprising:

a. a mounting board having a first surface, a second surface opposite the first surface, and a thickness between the first and second surfaces;

b. a first light emitting diode mounted on the first surface of the mounting board;

c. a first optic having a first chamber, the first optic being positioned on the first surface of the mounting board to process light from the first light emitting diode and such that a first coolant space is formed between the first chamber and the first light emitting diode for coolant flow around a light emitting portion of the first light emitting diode;

d. a second light emitting diode mounted on the first surface of the mounting board;

e. a second optic having a second chamber, the second optic being positioned on the first surface of the mounting board to process light from the second light emitting diode and such that a second coolant space is formed between the second chamber and the second light emitting diode for coolant flow around a light emitting portion of the second light emitting diode, the second coolant space being separate from the first coolant space;

f. a coolant inlet to the first coolant space;

g. a coolant outlet from the first coolant space;

h. a coolant inlet to the second coolant space;

i. a coolant outlet from the second coolant space;

j. a channel connecting the coolant outlet from the first coolant space to the coolant inlet to the second coolant space, wherein the channel extends at least partially through the thickness of the mounting board; and k. a circulating member for actively circulating coolant (i) into the coolant inlet to the first coolant space, (ii) through the first coolant space and around the light emitting portion of the first light emitting diode, (iii) through the channel, (iv) through the second coolant space and around the light emitting portion of the second light emitting diode, and (v) out of the coolant outlet from the second coolant space so as to actively transfer heat away from the first and second light emitting diodes.

2. The system as in claim 1, a wherein the coolant comprises at least one of gas, air, nitrogen, argon, carbon dioxide, liquid, flourinated hydrocarbon, or silicone fluid.

3. The system as in claim 1, a wherein at least one of the first or second optic comprises at least one of polycarbonate or acrylic.

4. The system as in claim 1, a wherein the index of refraction of the material that comprises at least one of the first or second optic is approximately equal to the index of refraction of the coolant.

5. The system as in claim 1, further comprising a heat sink, wherein the mounting board is positioned between the heat sink and the first and second light emitting diodes, wherein the channel extends entirely through the thickness of the mounting board, and wherein the channel at least partially extends within the heat sink.

6. The system as in claim 5, further comprising a layer of thermal interface material positioned between the heat sink and the mounting board.

7. An active cooling system comprising:

a. a mounting board;

b. a first light emitting diode and a second light emitting diode, wherein each of the first and second light emitting diodes are mounted to the mounting board; and c. an integral optic, wherein the integral optic has defined therein:

i. a first optical chamber that seats over the first light emitting diode such that a first coolant space is formed between the first optical chamber and the first light emitting diode for coolant flow around a light emitting portion of the first light emitting diode;

ii. a second optical chamber that seats over the second light emitting diode such that a second coolant space is formed between the second optical chamber and the second light emitting diode for coolant flow around a light emitting portion of the second light emitting diode, the second coolant space being separate from the first coolant space;

iii. a coolant inlet to the first coolant space;

iv. a coolant outlet from the first coolant space;

v. a coolant inlet to the second coolant space;

vi. a coolant outlet from the second coolant space; and vii. a channel connecting the coolant outlet from the first coolant space to the coolant inlet to the second coolant space; and d. a circulating member for actively circulating coolant (i) into the coolant inlet to the first coolant space, (ii) through the first coolant space and around the light emitting portion of the first light emitting diode, (iii) through the channel, (iv) through the second coolant space and around the light emitting portion of the second light emitting diode, and (v) out of the coolant outlet from the second coolant space so as to actively transfer heat away from the first and second light emitting diodes.

8. The system as in claim 7, further comprising a seal between at least a portion of the integral optic and the mounting board.

9. The system as in claim 7, further comprising a refrigeration system for removing heat from the coolant.

10. An active cooling system comprising:

a. a mounting board having a first surface, a second surface opposite the first surface, and a thickness between the first and second surfaces;

b. a first light emitting diode mounted on the first surface of the mounting board;

c. a first optic having a first chamber, the first optic being positioned on the first surface of the mounting board to process light from the first light emitting diode and such that a first coolant space is formed between the first chamber and the first light emitting diode for coolant flow around a light emitting portion of the first light emitting diode;

d. a second light emitting diode mounted on the first surface of the mounting board;

e. a second optic having a second chamber, the second optic being positioned on the first surface of the mounting board to process light from the second light emitting diode and such that a second coolant space is formed between the second chamber and the second light emitting diode for coolant flow around a light emitting portion of the second light emitting diode, the second coolant space being separate from the first coolant space;

f. a coolant inlet to the first coolant space;

g. a coolant outlet from the first coolant space;

h. a coolant inlet to the second coolant space;

i. a coolant outlet from the second coolant space;

j. a heat sink, wherein the mounting board is positioned between the heat sink and the first and second light emitting diodes;

k. at least one chamber channel and at least one plate channel that intersects with the at least one chamber channel, wherein the at least one chamber channel extends at least partially through the thickness of the mounting board and is configured to supply coolant to at least one of the first and second coolant spaces and wherein the at least one plate channel is defined and extends within the heat sink; and l. a circulating member for actively circulating coolant through the at least one chamber channel and the at least one plate channel, through the first coolant space and around the light emitting portion of the first light emitting diode, and through the second coolant space and around the light emitting portion of the second light emitting diode so as to actively transfer heat away from the first and second light emitting diodes.

11. An active cooling system comprising:

a. a mounting board comprising a first surface and a second surface opposite the first surface;

b. a heat sink mounted on the first surface of the mounting board and comprising a first aperture and a second aperture;

c. a first light source mounted on the first surface of the mounting board and positioned within the first aperture of the heat sink, wherein the first light source comprises a light emitting portion;

d. a second light source mounted on the first surface of the mounting board and positioned within the second aperture of the heat sink, wherein the second light source comprises a light emitting portion;

e. a first coolant inlet into the first aperture;

f. a first coolant outlet from the first aperture;

g. a second coolant inlet into the second aperture;

h. a second coolant outlet from the second aperture;

i. a first channel defined and extending within the heat sink for carrying coolant into the first coolant inlet, around the light emitting portion of the first light source, and out the first coolant outlet;

k. a second channel defined and extending within the heat sink for carrying coolant into the second coolant inlet, around the light emitting portion of the second light source, and out the second coolant outlet;

l. a third channel defined in the heat sink and connecting the first channel with the second channel; and m. a circulating member coupled to the heat sink for actively circulating coolant through the first, second, and third channels and around the light emitting portions of the first and second light sources so as to actively transfer heat away from the first and second light sources.

12. The system as in claim 11, further comprising a first optic to cover the first aperture and a second optic to cover the second aperture.

13. The system as in claim 11, further comprising a layer of thermal interface material between the mounting board and the heat sink.

* * * * *